US009797210B1

(12) United States Patent
Harris et al.

(10) Patent No.: US 9,797,210 B1
(45) Date of Patent: Oct. 24, 2017

(54) MILLING-DRILLING SECTION BILLET AND ANCHORING DEVICE

(71) Applicants: Robert Harris, Anchorage, AK (US); Carl Diller, Anchorage, AK (US); Candice English, Anchorage, AK (US); John Milne, Anchorage, AK (US)

(72) Inventors: Robert Harris, Anchorage, AK (US); Carl Diller, Anchorage, AK (US); Candice English, Anchorage, AK (US); John Milne, Anchorage, AK (US)

( * ) Notice: Subject to any disclaimer, the term of this patent is extended or adjusted under 35 U.S.C. 154(b) by 0 days.

(21) Appl. No.: 14/976,302

(22) Filed: Dec. 21, 2015

Related U.S. Application Data

(60) Provisional application No. 62/095,264, filed on Dec. 22, 2014.

(51) Int. Cl.

| | |
|---|---|
| ***E21B 23/01*** | (2006.01) |
| ***E21B 43/10*** | (2006.01) |
| ***E21B 23/04*** | (2006.01) |
| ***E21B 33/129*** | (2006.01) |
| ***E21B 47/10*** | (2012.01) |

(52) U.S. Cl.
CPC ..... *E21B 23/01* (2013.01)

(58) Field of Classification Search
None
See application file for complete search history.

(56) References Cited

U.S. PATENT DOCUMENTS

| | | | | |
|---|---|---|---|---|
| 8,464,812 | B2 * | 6/2013 | Radford | E21B 10/322 166/383 |
| 8,851,166 | B2 * | 10/2014 | Foubister | E21B 33/1294 166/129 |
| 2003/0010533 | A1 * | 1/2003 | Hart | E21B 7/04 175/61 |

* cited by examiner

*Primary Examiner* — Matthew R Buck
*Assistant Examiner* — Douglas S Wood
(74) *Attorney, Agent, or Firm* — Michael J. Tavella

(57) ABSTRACT

A milling-drilling section billet and anchoring device that is an improvement over current technology. The invention provides a device that incorporates an aluminum milling-drilling section billet and an anchoring device. The assembly is segregated into three main functional components: a setting tool connector system, an aluminum billet, and an anchoring section. The anchoring section has two slips, offset laterally and positioned 180 degrees apart on the device. When deployed, the slips lock the device in the formation and produce an offset of the billet within the formation. This angular positioning allows a milling head to be moved in a new direction from the existing well formation. Once the device is properly positioned in the wellbore, a frangible member breaks to allow removal of the setting tool prior to the renewed drilling operation.

12 Claims, 12 Drawing Sheets

MILLING-DRILLING SECTION BILLET AND ANCHORING DEVICE

CROSS REFERENCE TO RELATED APPLICATIONS

This application claims benefit of Provisional application 62/095,264 filed Dec. 22, 2014

STATEMENT REGARDING FEDERALLY SPONSORED RESEARCH AND DEVELOPMENT

Not Applicable

BACKGROUND OF THE INVENTION

1. Field of the Invention

This invention relates to milling-drilling section billets and particularly to milling-drilling section billet and anchoring devices.

2. Description of the Prior Art

Systems have been developed in oil well construction that allow drillers to depart, angularly, from an existing open-hole section of wellbore. One method to do this uses an aluminum cylinder that is connected to an anchoring device. The assembly is carried into the wellbore on drill pipe, tubing or coiled tubing that is connected to a commonly available industry standard hydro-mechanical setting tool, which is connected to the aluminum cylinder and anchoring device with a frangible member. The function of the setting tool is to convert the force supplied by hydraulic pumps, pumping against a closed system within the bore of the carrying pipe, against piston areas within the setting tool that convert this force into mechanical movement/action.

The assembly is carried into the wellbore and positioned within the open-hole section of the wellbore. Upon activation of the setting tool, the anchoring device expands some type of retention locking slips along its axis and forces them outwards against an angular cone, which contacts the bore wall and anchors the assembly in place. This mechanical activation of the anchoring device along with the slip configuration geometry causes the assembly to pivot about a point, which then causes the assembly to pivot axially along the wellbore, forcing the top of the aluminum cylinder to cantilever over until it contacts the borehole. Upon contact of the locking slips with the bore wall, the billet is locked against the bore wall and, consequently, no further axial motion is permitted within the aluminum cylinder and anchoring device. This transfers any additional axial loading into the frangible member, which fails upon reaching its maximum load bearing capacity. At the point when fracture occurs, the setting tool separates from the aluminum cylinder and anchoring device. The setting tool is then retrieved to surface, leaving the billet locked in place within the wellbore. The setting too is replaced with a drilling bottom hole assembly to continue the drilling operation.

Subsequent drilling bottom hole assemblies are then deployed and using the aluminum cylinder as a hard deflection device (as compared to the softer formation) the drilling bottom hole assembly is deflected onto a new drilling path that is more favorable to the operation and wellbore trajectory requirements.

One example of such a device is found in U.S. Pat. No. 6,695,056.

BRIEF DESCRIPTION OF THE INVENTION

The instant invention is a milling-drilling section billet and anchoring device that is an improvement over current technology. The invention provides a device that incorporates an aluminum milling-drilling section billet and an anchoring device. The design includes additional functions and features not currently available in the billet technology of the prior art: first, the setting tool is connected to the aluminum billet-anchoring device in such a way that no axial loads are transferred to the frangible member until the initiating of the setting sequence, which reduces the incidence of premature initiation of the setting sequence due to borehole conditions or operator error. Second, the slip/anchor design is unique in that it is a single piece construction providing a significant increase in radial anchor reach over other commonly available designs of similar application. Third, the radial energy provided by the axial motion of the setting tool to engage the anchoring mechanism to the bore wall is stored within the tool after setting tool release by the use of both a locking mechanism and spring device. Fourth, the anchor mechanism is designed so that a secondary slip is activated during the setting sequence, which extends radially to a predetermined radius. This secondary slip is positioned within the assembly 180° rotationally offset from the main slip and is axially separated by a predetermined length. The secondary slip acts as both an anchoring section as well as creating a pivot point axially along the billet-anchor assembly. As the radially extending motion of the main slip makes contact with the bore wall it creates an axial pivoting motion, which forces the billet-anchor to rotate around the fulcrum of the secondary slip. This cam action forces the upper section of the billet to be pushed to one side of the borehole while the anchoring section is moved 180° in the opposite direction. This action both further supports the billet-anchor assembly within the borehole as well as radially fills the empty spaces within the borehole when viewed from a top down perspective.

Fifth, the setting tool is uniquely rotationally locked to the billet/anchor allowing the entire setting assembly to be rotated within the borehole to position the anchor section, when viewed from a top down perspective, at the optimum rotational angle for maximum setting efficiency.

To that end, the assembly is segregated into three main functional components: a setting tool connector system, an aluminum billet, and an anchoring section.

DETAILED DESCRIPTION OF THE INVENTION

Figure 1:
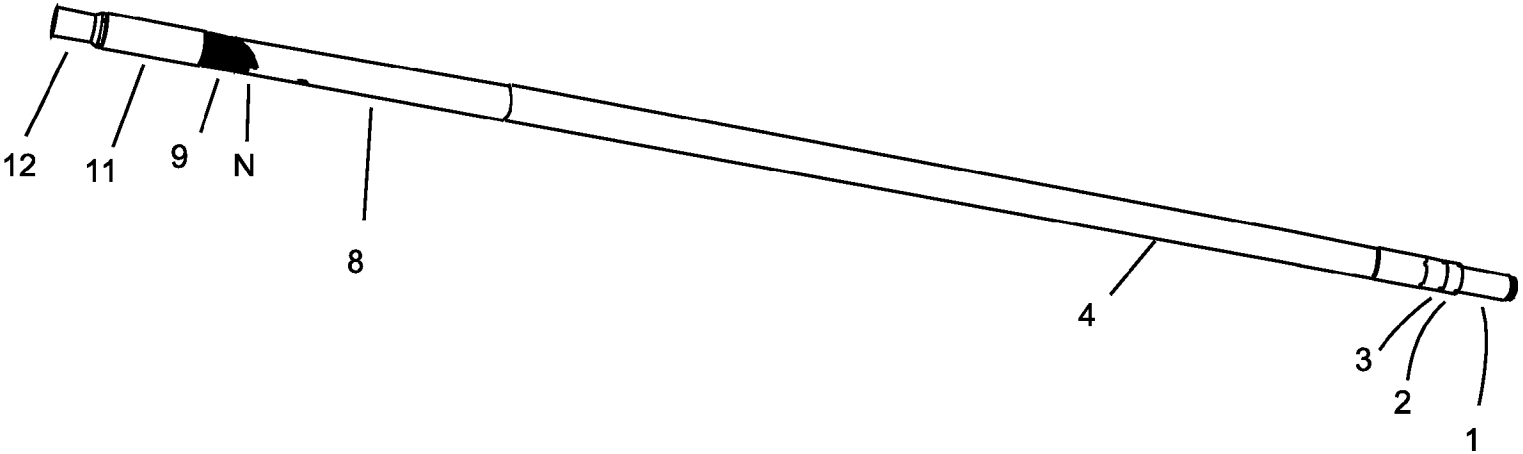
FIG. 1 is a perspective view of the new billet system.
Figure 2:
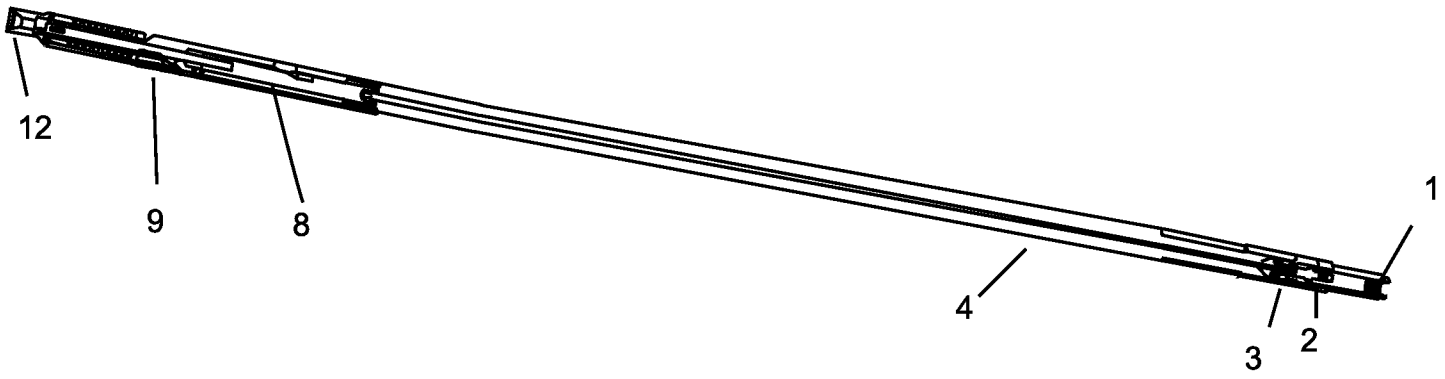
FIG. 2 is a perspective cut-away view of the new billet system.
Figure 3:
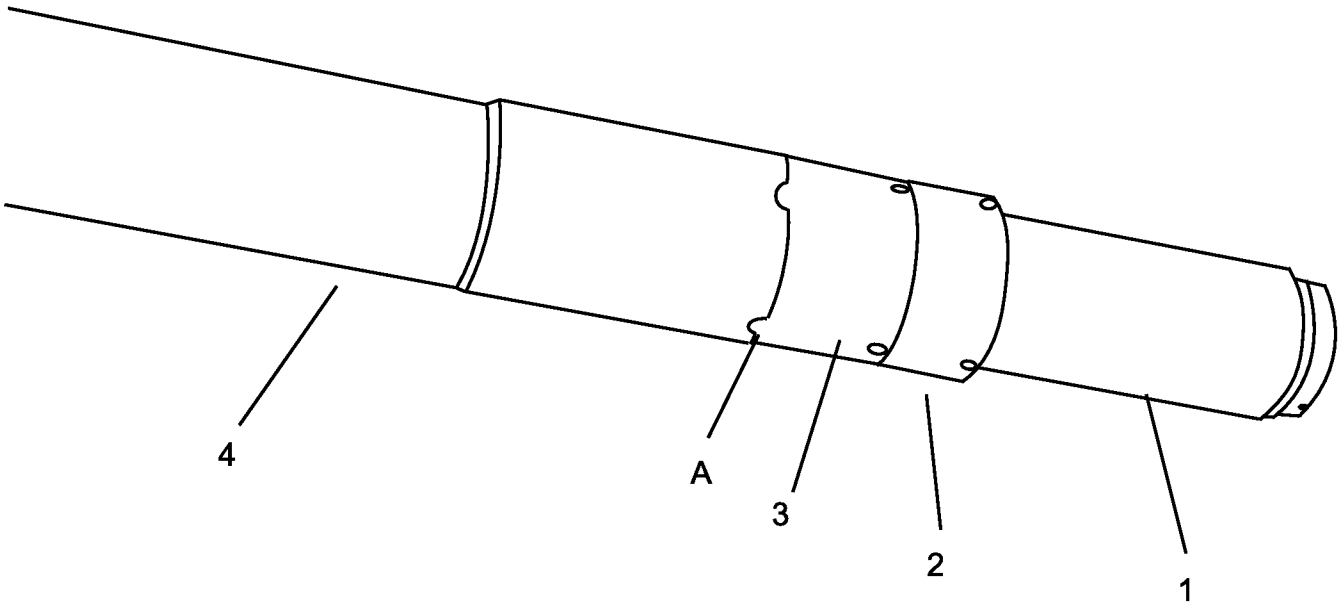
FIG. 3 is an enlarged detail of the setting tool adapter kit portion of the system.

Below is a list of the components (sorted by reference numeral) of this system:

1. Adapter Sleeve
2. Lock Collar
3. Torque Collar
4. Aluminum Billet
5. Lock Dog
6. Adapter
7. Setting Rod
8. Anchor Mandrel
9. Lower Slip
10. Upper Cone
11. Spring Sleeve
12. Bottom Sub
13. Drive Ring
14. Upper Slip
15. Spring
16. Crosslink Key
17. Crosslink Mandrel
18. Hex Socket Set Screw
19. Lock Mandrel
20. Shear Ring
21. Body Lock Ring Housing
22. Body Lock Ring
23. Lock Nut
24. Shear Rod
25. Hex Socket Set Screw
26. Shear Screw The assembly is segregated into three main functional components:

1) the setting tool connector kit (items—1,2,3,5,6 & 7);

2) the aluminum billet (item 4); and 3) the anchoring section (items—8,9,10,11,12,13,14,15, 16,17,18,19,20,21,22 & 23).

The setting tool connector kit is connected to a commonly available industry standard hydro-mechanical setting tool (not shown).

Figure 4:
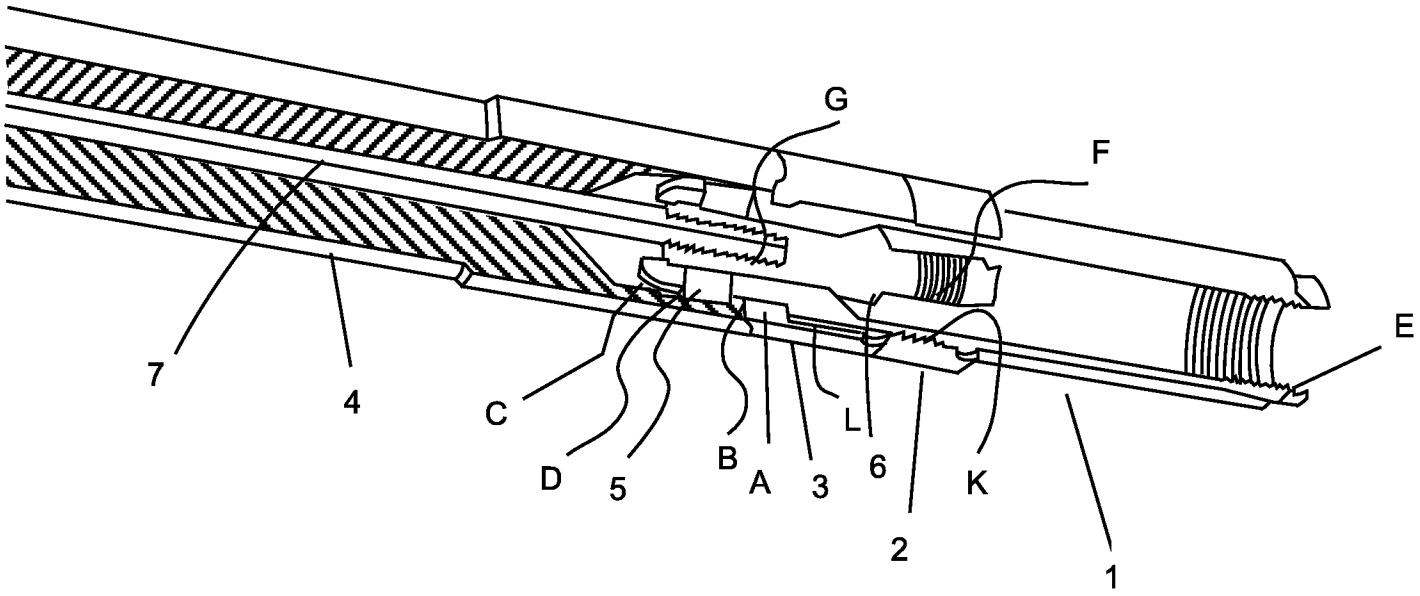
FIG. 4 is an enlarged cut-away view of the setting tool adapter kit portion of the system.
Figure 5:
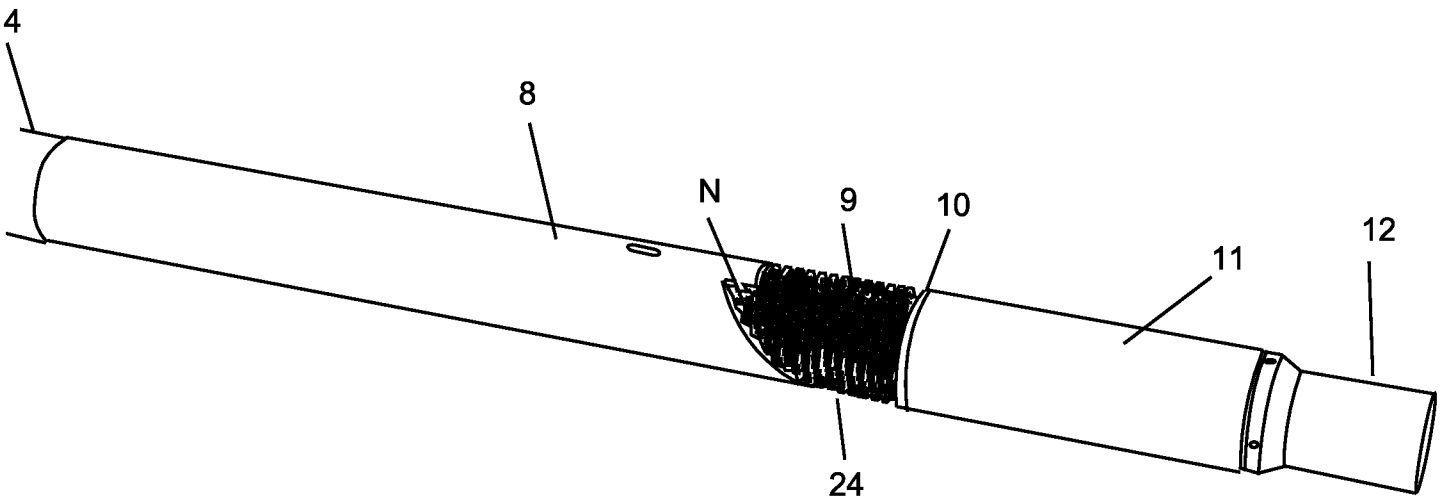
FIG. 5 is an enlarged detail view of a portion of the anchoring section of the billet system.
Figure 6:
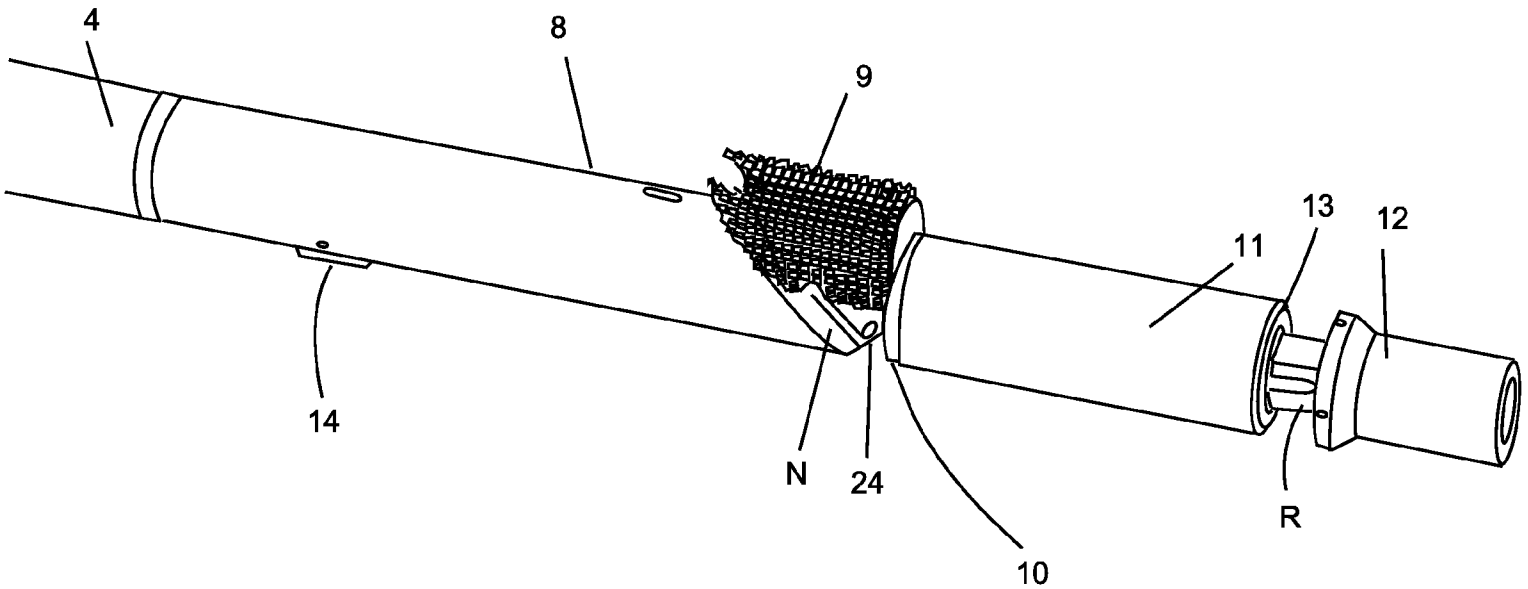
FIG. 6 is an enlarged detail view of a portion of the anchoring section of the billet system showing both the upper and lower slips expanded.
Figure 7:
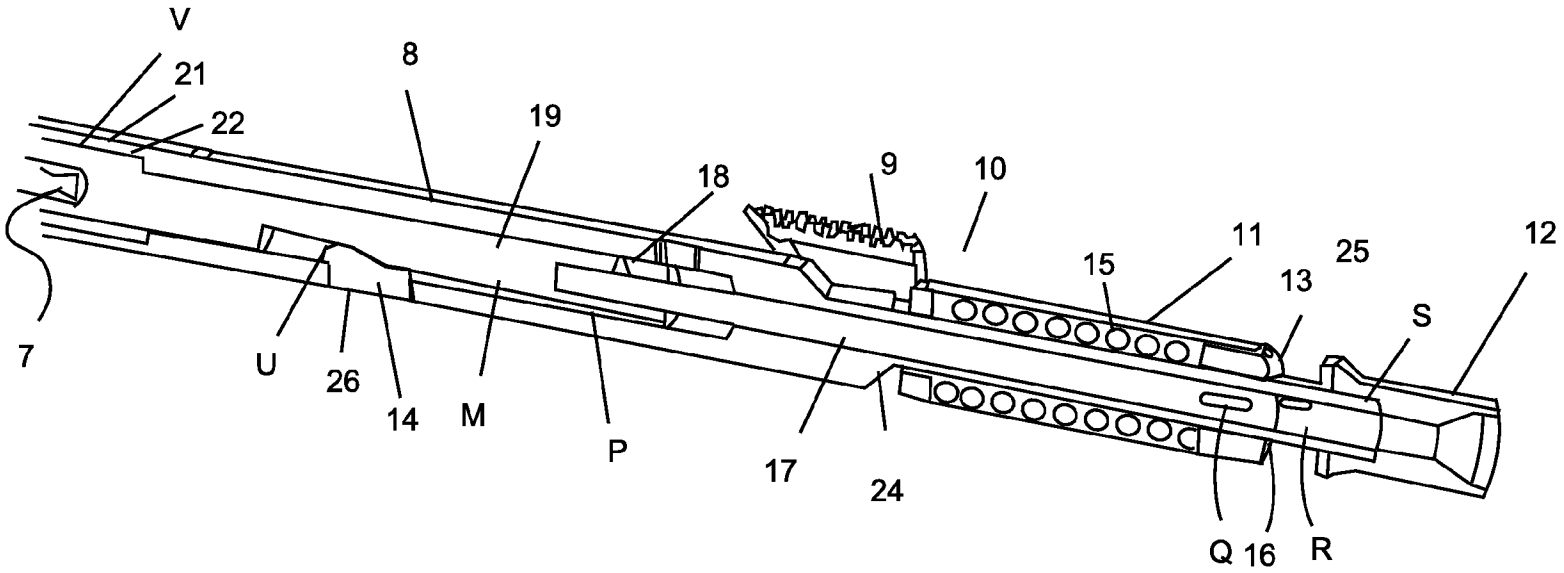
FIG. 7 is an enlarged detail cut-away view of a portion of the anchoring section of the billet system showing a lower slip expanded.

Referring now to the drawing figures, the invention is assembled as follows:

Referring now to FIGS. 1-4 and particularly FIG. 4, a lock collar 2 and torque collar 3 are threaded onto an adapter sleeve 1 using threads K and L. A lock dog 5 is installed into retaining pockets of the adapter sleeve 1. Next, an adapter 6 and setting rod 7 are connected together using the threads G. Note that threaded member F of the adapter 6 is connected to the corresponding threaded member of the setting tool (not shown). Next, the subassembly of components of items 1,2,3,4 and 5 are slid over items 6 and 7. The entire assembly is then placed into the aluminum billet 4 as shown. Note that thread E of the adapter sleeve 1 is used to thread the device onto the corresponding threads of the setting tool (not shown). In making up this assembly, the torque collar 3 (FIG. 3) is adjusted by rotation against the thread L (FIG. 4) until it is in contact with the face of the aluminum billet 4, orientating the torque tangs A (FIG. 3) until meshed together as shown. The torque collar 3 is then additionally rotated until no further rotation can be achieved. This indicates that contact point A has reached contact point B (FIG. 4), which locks the assembly into the recessed pocket D (FIG. 4) within the aluminum billet 4. Next, the lock collar 2 is threaded onto the assembly using thread K until contact with the face of the torque collar 3 is made, which locks the lock collar 2 and the torque collar 3 in place. Note that the elements of reference numerals 1,2,3,5,6 & 7 are considered to be a means for disengaging said setting tool assembly from said billet.

Figure 8:
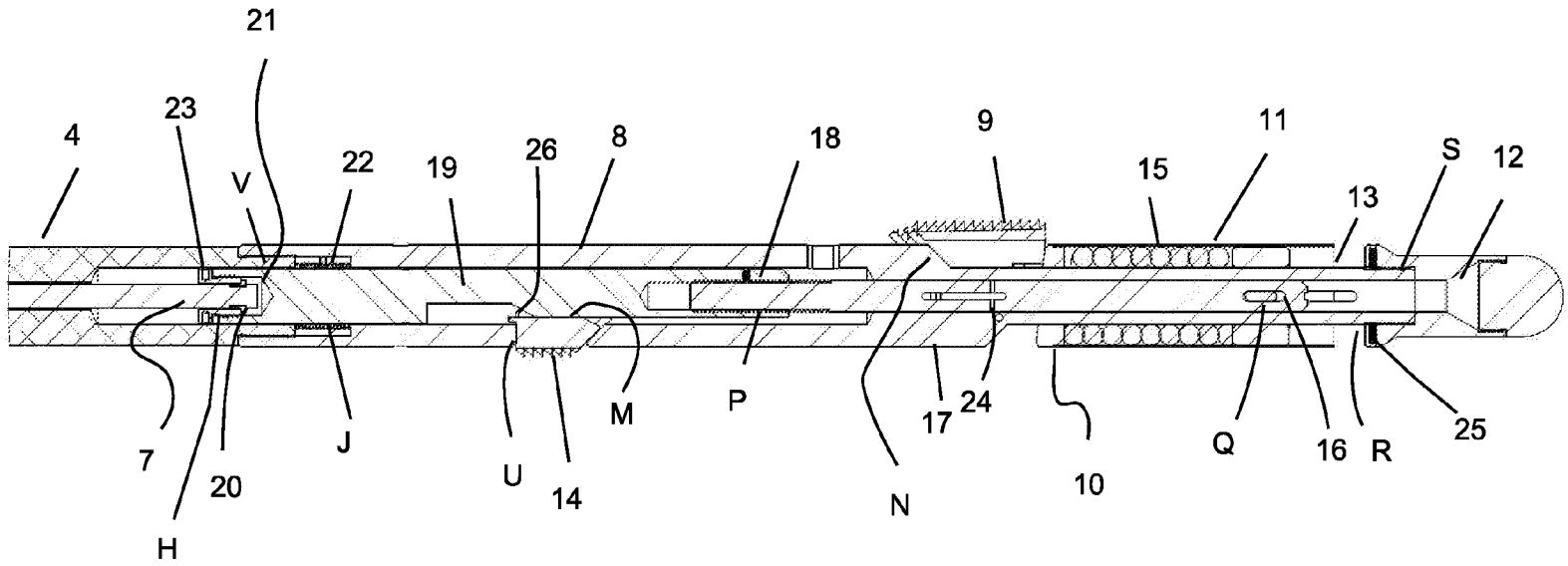
FIG. 8 is an enlarged detail cut-away view of a larger portion of the anchoring section of the billet system showing a second embodiment of the upper and lower slips expanded.

Referring now to FIGS. 5-8, and especially, FIG. 8, details of the assembly at the anchor end of the device are shown. To assemble this portion, a shear ring retainer 23 is slid onto the opposite end of the setting rod 7, which has already been installed in the billet 4. Next, a shear ring 20 is installed into a recess of the setting rod 7. Next, a lock nut 23 and a lock mandrel 19 are threaded together using threads H.

Again referring to FIG. 8, the upper slip 14 is installed into the recess of the anchor mandrel 8 and then they are slid over a lock mandrel 19, which aligns the milled flats M with the flat face of the upper slip 14. Next, the anchor mandrel 8 is threaded to the aluminum billet 4 using thread J. Next, the lower slip 9 is slid onto the anchor mandrel 8 using the T-Slot N, after which a shear rod 24 is installed. Next, an upper cone 10, a drive ring 13 and a spring 15 are slid onto the anchor mandrel 8.

Then the crosslink mandrel 17 is installed into the bore of the anchor mandrel 8 and then threaded to the lock mandrel 19 using thread P, until the slots on the anchor mandrel 8, drive ring 13 and the crosslink mandrel 17 are aligned at point Q. Next, a crosslink key 16 is installed through the anchor mandrel 8, drive ring 13 and the crosslink mandrel 17 at Q, which retains the components in the anchor mandrel 8. Next, a hex socket setscrew 18 is installed in the lock mandrel 19 through a slot on the anchor mandrel 8, as shown. Next, the spring sleeve 11 is slid over the drive ring 13 and the spring 15. Next, a bottom sub 12 is threaded to the anchor mandrel 8 using thread S. Then a hex socket setscrew 25 is installed in the bottom sub 12. Finally, a shear screw 26 is installed through the anchor mandrel 8 into the upper slip 14, which holds the upper slip 14 in place.

Figure 9:
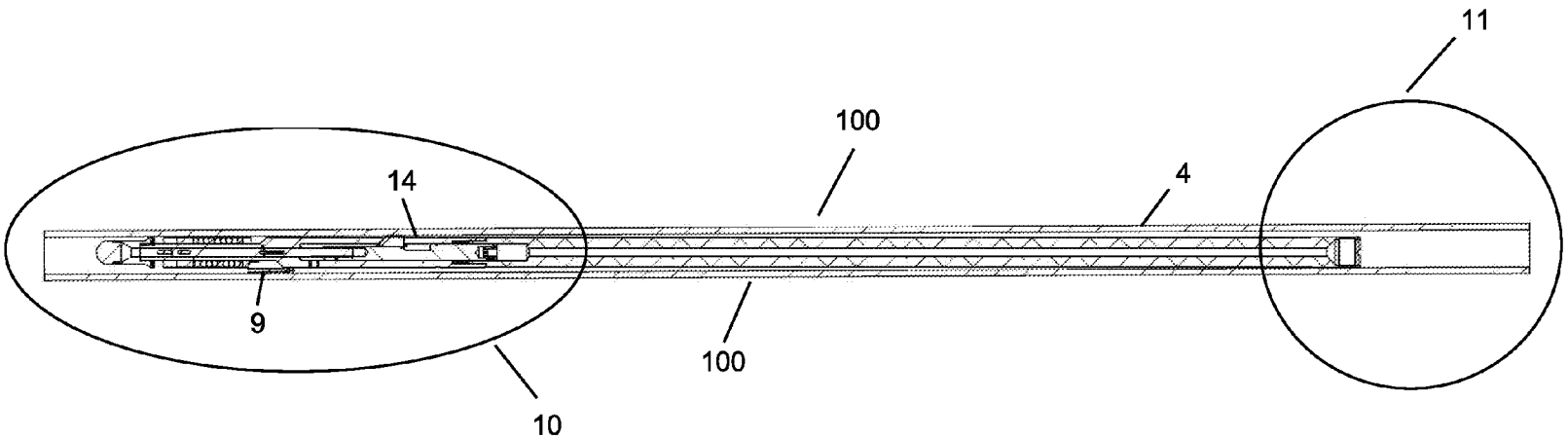
FIG. 9 is a detail view showing the tool as set in a wellbore with the setting tool section removed and the slips expanded.
Figure 10:
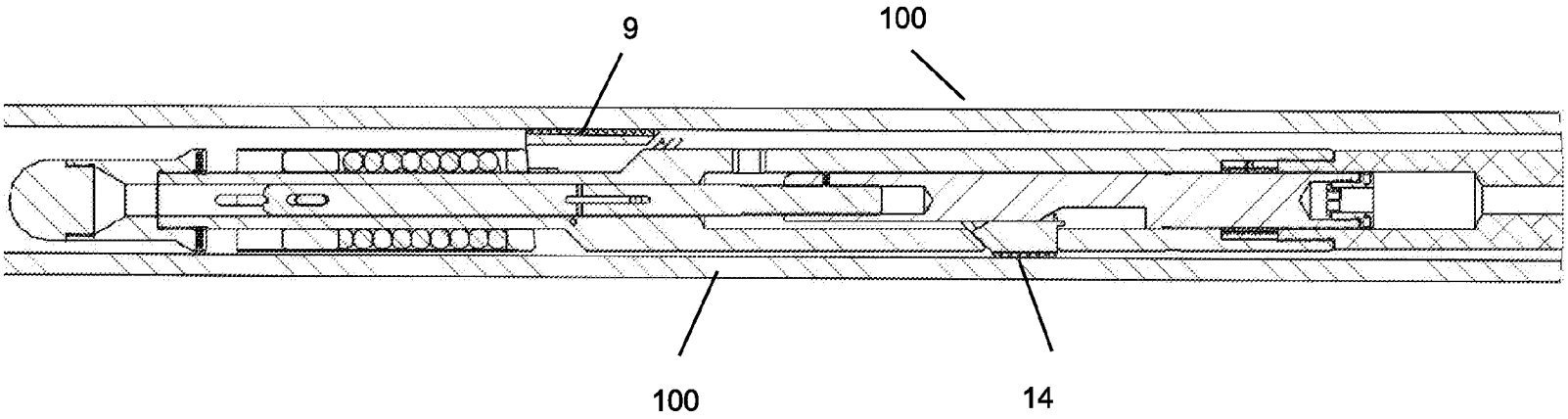
FIG. 10 is an enlarged detail view of the lower portion device, labeled 10 on FIG. 9, as set in a wellbore, with the slips expanded.
Figure 11:
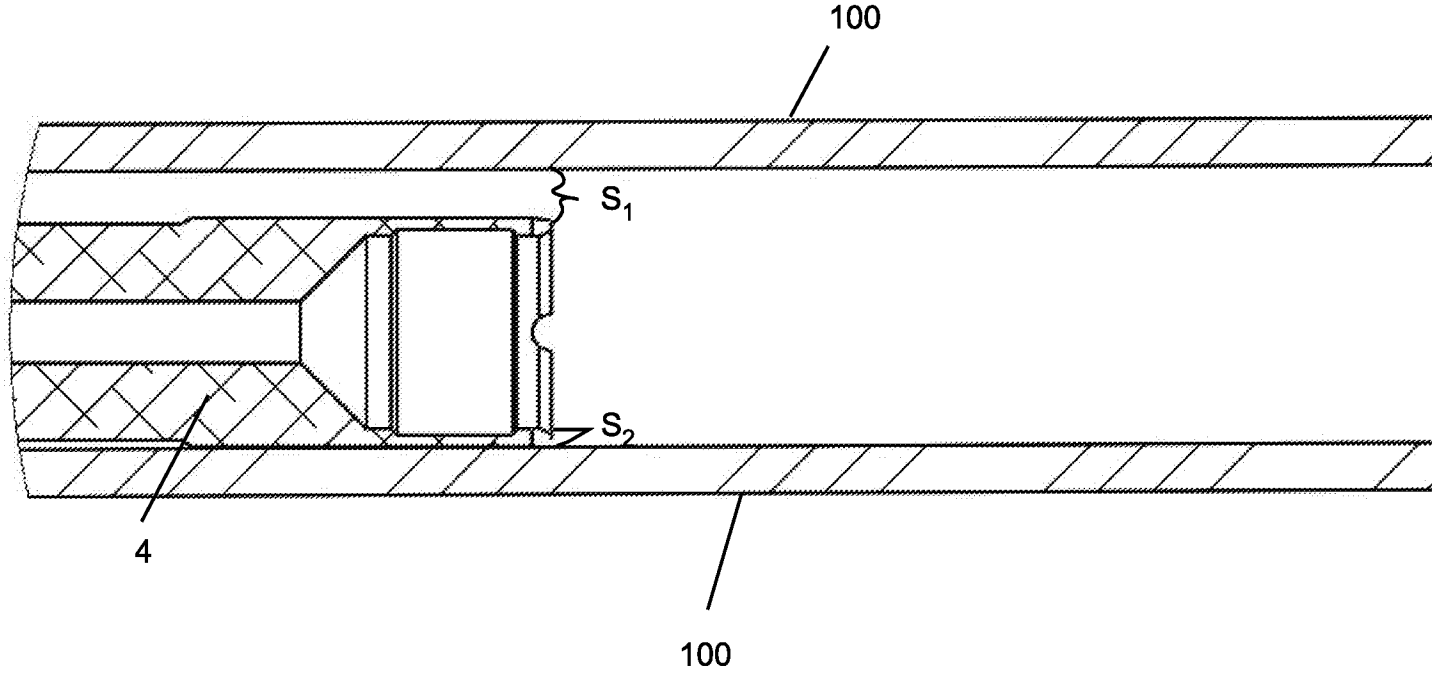
FIG. 11 is a detail of the top portion of the device, labeled 11 on FIG. 9 with the setting tool section removed and the slips in place. This view shows the offset of the device in the wellbore.

FIG. 9 is a detail view showing the tool as set in a wellbore 100 with the setting tool section 1,2,3,5,6 and 7 removed and the slips 9 and 14 expanded. Note that the wellbore 100 is not cased, but bare rock. FIG. 10 is an enlarged detail view of the lower portion device, labeled 10 on FIG. 9, as set in a wellbore, with the slips 9 and 14 expanded. FIG. 11 is a detail of the top portion of the device, labeled 11 on FIG. 9 with the setting tool section 1,2,3,5,6 and 7 removed and the slips (not shown) in place. This view shows the offset of the device in the wellbore. Note how the tool is shown closer to one wall than the other. The bigger gap $S_1$ compared with the smaller gap $S_2$ shows this offset. It is this slight offset that allows for the drilling head to be directed outward from the wellbore in a new direction.

Figure 12:
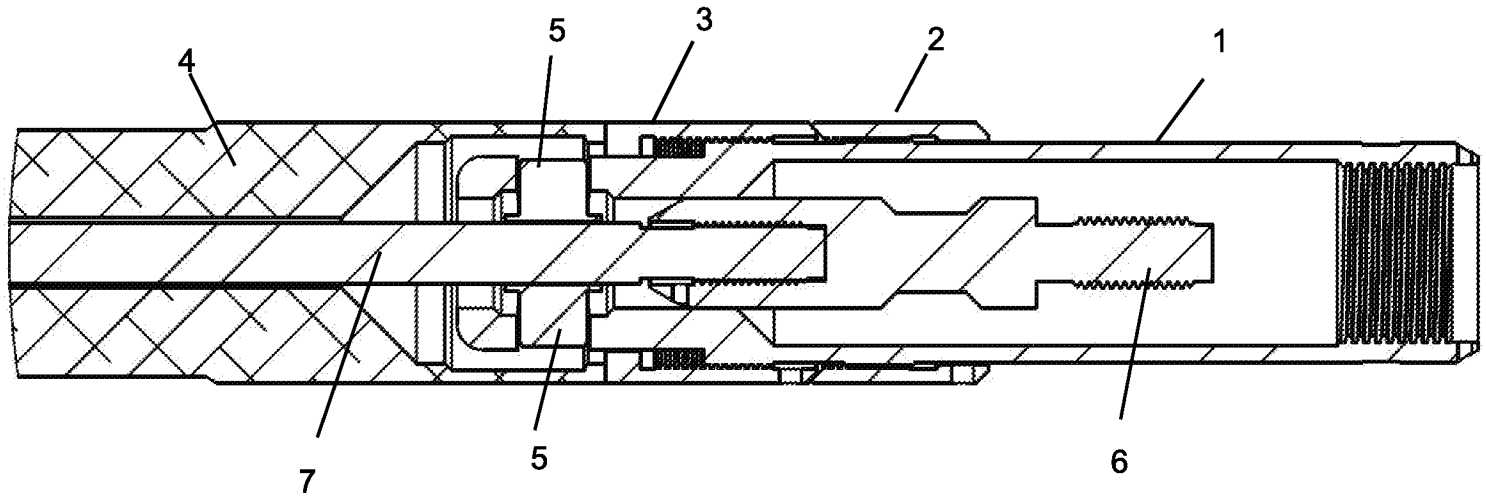
FIG. 12 is an enlarged cutaway view of the setting tool portion showing the central rod removed and the locking clips collapsed. In this view, the setting tool portion is ready to be removed from the device.

FIG. 12 is an enlarged cutaway view of the setting tool portion showing the central rod removed and the lock dogs collapsed. In this view, the adapter sleeve 1, the lock collar 2, the torque collar 3, the aluminum billet 4, and the lock dogs 5 are shown. As discussed below, once the rod 7 and the adapter 6 are removed from the device, items 1, 2 and 3, are released from the tool and can be pulled out and upwards from the tool. In this way, the setting tool can be removed from the wellbore with the tool locked in place.

Tool Function

The assembled tool is ran into the wellbore and positioned at a desired setting depth. The anchor assembly is orientated to position the slip 9 vertically in relation to the wellbore either in the straight up or straight down position. (Straight up is shown within the drawings). Rotation is achieved using the torsion-locked connection between the setting tool and tangs A on the adapter kit through the assembly using the aluminum billet 4 of the anchor assembly. On activation of the hydro/mechanical setting tool, the setting tool creates a push on the adapter sleeve 1 and a pull on the adapter 6. The axial motion of the setting tool forces the setting rod components of the adapter, including the setting rod 7, the lock nut 23, the shear ring 20, the lock mandrel 19, the crosslink mandrel 18, and the crosslink key 16, to pull up relative to the static outer assembly components. This action causes a series of mechanical operations within the assembly. First, the movement of the adapter 6 and the setting rod 7, relative to the lock dogs 5 is such that the adapter 6 no longer supports the lock dogs 5 at C that allows the lock dogs 5 to move radially inwards, which unlocks the upper setting adapter setting sleeve 1, the lock collar 2, and the torque collar 3 from the aluminum billet 4. Thus, the movement of the adapter 6 and the setting rod 7 constitutes a means of disengaging said lock dogs from a first, locked, position to a second, unlocked position. Simultaneously, the spring 15 begins to compress as the drive ring 13 moves axially through the connection with the cross-ink mandrel 17 by the crosslink key 16. Continued movement causes the fracture of the shear rod 24, which unlocks the slip 9 and forces the slip 9 to move both axially and radially within the T-slot N. Note that these components can be considered as a means for moving said upper and lower slips from said first position to said second position. Simultaneously, the lock mandrel 19 moves axially against the body lock ring 22 while the upper slip 14 is pushed radially out against taper U, which causes the fracture of the shear screw 26, which further causes the subsequent outward free movement of the upper slip 14 until it mates with the flat portion on the lock mandrel 19 at M. Continued movement of the adapter 6, the setting rod 7, the lock nut 23, the shear ring 20, the lock mandrel 19, the crosslink mandrel 18, and the crosslink key 16, causes the further movement of the lower slip 9 axially and radially out until contact with the wellbore is attained. Note these components can be considered as a means for locking said upper and lower slips in the expanded position. This movement prevents further axial displacement of the adapter 6, the setting rod 7, the lock nut 23, the shear ring 20, the lock mandrel 19, the crosslink mandrel 18, and the crosslink key 16. The continued axial movement of the setting tool transfers the axial loading into the shear ring 20, which is retained by the lock nut 23 at face V. Upon reaching the fracture gradient of the shear ring 20, the shear ring 20 will fail, causing the adapter 6, and the setting rod 7 to move freely axially. This action allows the setting adapter assembly of the setting sleeve 1, the lock collar 2, the torque collar 3, the adapter 6, and the setting rod 7, along with the hydro/mechanical setting tool, to be removed from within the bore of the aluminum billet 4 while simultaneously, the lock mandrel 19 is prevented from returning to its original position by the body lock ring 22 within body lock ring housing 21. This action also prevents the spring 11 from returning to a relaxed position, which maintains a constant force on the lower slip 9 and the upper cone 10.

The now-freed setting adapter can be returned to surface.

Subsequent drilling of bottom hole assemblies are then deployed and, as before, using the aluminum cylinder as a hard deflection device (in comparison to the softer formation) the drilling bottom hole assembly is deflected onto a new drilling path that is more favorable to the operation and wellbore trajectory requirements.

The design is unique to the application in several ways.

The setting tool is connected to the aluminum billet-anchoring device in such a way that no axial loads are transferred to the frangible member until the initiating of the setting sequence, which reduces the incidence of premature initiation of the setting sequence due to borehole conditions or operator error.

The slip/anchor design is unique in that it is a single piece construction providing a significant increase in radial anchor reach over other commonly available designs of similar application.

The radial energy provided by the axial motion of the setting tool to engage the anchoring mechanism to the bore wall is stored within the tool after setting tool release by the use of both a locking mechanism and spring device.

The anchor mechanism is designed in such a way that a secondary slip is activated during the setting sequence, which extends radially to a predetermined radius. This secondary slip is position within the assembly 180° rotationally offset from the main slip and is axially separated by a predetermined length. The secondary slip acts as both an anchoring section as well as creating a pivot point axially along the billet-anchor assembly. As the radially extending motion of the main slip makes contact with the bore wall it creates an axial pivoting motion, which forces the billet-anchor to rotate around the fulcrum of the secondary slip. This cam action forces the upper section of the billet to be pushed to one side of the borehole while the anchoring section is moved 180° in the opposite direction. This action both further supports the billet-anchor assembly within the borehole as well as radially fills the empty spaces within the borehole when viewed from a top down perspective.

The setting tool is uniquely rotationally locked to the billet/anchor allowing the entire setting assembly to be rotated within the borehole to position the anchor section, when viewed from a top down perspective, at the optimum rotational angle for maximum setting efficiency.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. A milling-drilling section billet and anchoring device for use in open wellbores, comprising:

a) a setting tool assembly;

b) a billet having a top and a bottom, the top of said billet being removably attached to said setting tool assembly; and c) an anchoring portion, attached to the bottom of said billet and extending downwardly therefrom, having an upper slip and a lower slip, said upper and lower slips being expandably positioned within said anchoring portion such that said upper and lower slips have a first position in which said upper and lower slips remain substantially within said anchoring portion, and a second portion in which said upper and lower slips are expanded beyond the outer surface of said anchoring portion;

d) pair of lock dogs, installed in said setting tool assembly; and e) a means of disengaging said lock dogs from a first, locked, position to a second, unlocked position;

f) further wherein when said upper and lower slips are in said first position, said milling-drilling section billet and anchoring device is in a substantially longitudinal alignment within said wellbore and when said upper and lower slips are in said second position said milling-drilling section billet and anchoring device is positioned askew with respect to said wellbore.

2. The billet and anchoring device of claim 1 wherein said upper and lower slips have a plurality of rock gripping appendages attached thereto.

3. The billet and anchoring device of claim 1 wherein said billet is made of aluminum.

4. The billet and anchoring device of claim 1 wherein said anchoring portion includes a means for moving said upper and lower slips from said first position to said second position.

5. The billet and anchoring device of claim 1 wherein said anchoring device further comprises a means for locking said upper and lower slips in said second position.

6. The billet and anchoring device of claim 4 wherein the means for moving said upper and lower slips from said first position to said second position includes:

a) a crosslink mandrel;

b) a crosslink key operably positioned within said crosslink mandrel;

c) a shear rod operably positioned within said crosslink mandrel; and s) a T-slot formed in said crosslink mandrel.

7. A method of installing a milling-drilling section billet and anchoring device in an open wellbore having a setting tool assembly, a billet having a top and a bottom, removably attached to said setting tool assembly, an anchoring portion, attached to the bottom of said billet and extending downwardly therefrom, having an upper slip and a lower slip, said upper and lower slips being expandable with respect to said anchoring portion such that said upper and lower slips have a first position in which said upper and lower slips remain substantially within said anchoring portion, and a second portion in which said upper and lower slips are expanded beyond the outer surface of said anchoring portion, a means for disengaging said setting tool assembly from said billet, means for moving said upper and lower slips from said first position, and the means for locking said upper and lower slips in said second position, comprising the steps of:

a) positioning said billet and anchoring device into the wellbore at a desired setting depth;

b) orienting said lower slip vertically in relation to said wellbore either in a straight up or straight down position;

c) rotating said billet;

d) pushing on an adapter sleeve and pulling on an adapter installed in said device, thereby causing said lower slip to move to said second position, while causing said upper slip to also move to said second position;

e) causing said means for locking said upper and lower slips to lock said upper and lower slips in said second position, thereby causing said billet to become askew with respect to said wellbore, within said wellbore;

f), releasing said setting tool assembly from said billet; and g) causing said setting tool assembly to be removed from said wellbore.

8. The method of claim 7 wherein the step of causing said lower slip to move to said second position while causing said upper slip to also move to said second position further comprising the step of: pulling up on a lock nut, a shear ring, a lock mandrel, a crosslink mandrel, and a crosslink key, all installed within said billet and anchoring portions.

9. The method of claim 8 further comprising the steps of:

a) moving an adapter and a setting rod, relative a pair of lock dogs, positioned within said setting tool assembly such that the adapter no longer supports the pair of lock dogs; and b) allowing said lock dogs to move radially inwards, which unlocks an upper setting adapter setting sleeve, a lock collar 2, and a torque collar, forming the setting tool assembly from the said billet.

10. The method of claim 9 further comprising the steps of:

a) moving a drive ring axially through a connection with the crosslink mandrel by the crosslink key;

b) compressing a spring as a drive ring moves axially through the connection with the crosslink mandrel and crosslink key;

c) continuing the movement until a shear rod within said anchoring portion fractures, which unlocks the lower slip and forces the lower slip to move both axially and radially within a T-slot positioned behind said lower slip;

d) simultaneously moving the lock mandrel axially against a body lock ring;

e) pushing the upper slip radially out against a taper; and f) fracturing a shear screw, causing the subsequent outward free movement of the upper slip until it mates with the flat portion on the lock mandrel.

11. The method of claim 10 further comprising the step of:

a) moving the adapter, the setting rod, the lock nut, the shear ring, the lock mandrel, the crosslink mandrel, and the crosslink key, to cause further movement of said lower slip axially and radially out until contact with the wellbore is attained.

12. The method of claim 11 further comprising the steps of:

a) moving the adapter, the setting rod, the lock nut, the shear ring, the lock mandrel, the crosslink mandrel, and the crosslink key until a fracture gradient of the shear ring causes said shear ring to fail, thereby allowing the adapter, and the setting rod to move freely axially; and b) removing the setting adapter assembly the adapter, and the setting rod, from within the bore of the billet; and b) simultaneously preventing the lock mandrel from returning to an original position of said lock mandrel, thereby preventing the spring from returning to a relaxed position, thereby maintaining a constant force on the lower slip.

* * * * *